US007229330B2

(12) United States Patent
Walser et al.

(10) Patent No.: US 7,229,330 B2
(45) Date of Patent: Jun. 12, 2007

(54) WATERCRAFT SPEED CONTROL DEVICE

(75) Inventors: Michael W. Walser, Comfort, TX (US); Kennon H. Guglielmo, San Antonio, TX (US); Kenneth R. Shouse, San Antonio, TX (US)

(73) Assignee: Econtrols, Inc., San Antonio, TX (US)

( * ) Notice: Subject to any disclaimer, the term of this patent is extended or adjusted under 35 U.S.C. 154(b) by 93 days.

(21) Appl. No.: 11/056,848

(22) Filed: Feb. 11, 2005

(65) Prior Publication Data

US 2005/0176312 A1 Aug. 11, 2005

Related U.S. Application Data

(60) Provisional application No. 60/543,610, filed on Feb. 11, 2004.

(51) Int. Cl.
*B60L 1/14* (2006.01)
*B60L 3/00* (2006.01)

(52) U.S. Cl. ..... 440/2; 701/21

(58) Field of Classification Search ..... 440/1, 440/2; 701/21

See application file for complete search history.

(56) References Cited

U.S. PATENT DOCUMENTS

| | | | | |
|---|---|---|---|---|
| 5,074,810 | A | 12/1991 | Hobbs | |
| 5,110,310 | A * | 5/1992 | Hobbs | 440/1 |
| 6,227,918 | B1 | 5/2001 | Wharton | |
| 6,353,781 | B1 * | 3/2002 | Spivak | 701/21 |
| 6,485,341 | B1 | 11/2002 | Lanyi | |
| 6,517,396 | B1 | 2/2003 | Into | |
| 6,884,128 | B2 * | 4/2005 | Okuyama et al. | 440/1 |

* cited by examiner

*Primary Examiner*—Jesús D. Sotelo
(74) *Attorney, Agent, or Firm*—Jackson Walker, L.L.P.; William B. Nash; Mark Tidwell

(57) ABSTRACT

An automatic speed control system that provides desired watercraft velocity over land. The coupled algorithms correct engine speed and torque using GPS and tachometer measurements, and the corrections are augmented and enhanced by velocity/speed and torque/speed relationships that are dynamically and adaptively programmed with real-time data collected during replicated operations of the watercraft in specified conditions.

23 Claims, 4 Drawing Sheets

WATERCRAFT SPEED CONTROL DEVICE

This patent claims priority from and incorporates by reference U.S. Patent Application Ser. No. 60/543,610, Filed Feb. 11, 2004.

FIELD OF THE INVENTION

The present invention pertains to the field of watersports and boating.

BACKGROUND OF THE INVENTION

Competitors in trick, jump, and slalom ski and wakeboard events require tow boats capable of consistent and accurate speed control. Intricate freestyle tricks, jumps, and successful completion of slalom runs require passes through a competition water course at precisely the same speed at which the events were practiced by the competitors. Some events require that a pass through a course be made at a specified speed. Such requirements are made difficult by the fact that typical watercraft Pitot tube and paddle wheel speedometers are inaccurate and measure speed over water instead of speed over land, and wind, wave, and skier loading conditions constantly vary throughout a competition pass.

Marine transportation in general suffers from the lack of accurate vessel speed control. The schedules of ocean-going vessels for which exact arrival times are required, for example, are vulnerable to the vagaries of wind, waves, and changing hull displacement due to fuel depletion.

SUMMARY OF THE INVENTION

The present invention provides consistent, accurate control of watercraft speed over land. It utilizes Global Positioning Satellite technology to precisely monitor watercraft velocity over land. It utilizes dynamic monitoring and dynamic updating of engine control data in order to be responsive to real-time conditions such as wind, waves, and loading.

DETAILED DESCRIPTION OF THE PREFERRED EMBODIMENT

The present invention is an electronic closed-loop feedback system that controls the actual angular velocity $\omega_a$ of a boat propeller, and, indirectly, the actual over land velocity $v_a$ of the watercraft propelled by that propeller. The system has various configurations, but the preferred embodiment includes a global positioning satellite (GPS) velocity measurement device, a marine engine speed tachometer, four comparators, four conversion algorithms, and engine speed controls.

Herein, a GPS device is one of the category of commonly understood instruments that use satellites to determine the substantially precise global position and velocity of an object. Such position and velocity measurements can be used in conjunction with timers to determine an object's instantaneous velocity and average velocity between two points. Engine speed refers to angular velocity, generally measured with a device herein referred to as a tachometer. A comparator is any analog or digital electrical, electronic, mechanical, hydraulic, or fluidic device capable of determining the sum of or difference between two input parameters, or the value of an input relative to a predetermined standard. An algorithm is any analog or digital electrical, electronic, mechanical, hydraulic, or fluidic device capable of performing a computational process. The algorithms disclosed herein can be performed on any number of devices commonly called microprocessors or microcontrollers, examples of which include the Motorola® MPC555 and the Texas Instruments® TMS320.

Figure 1:
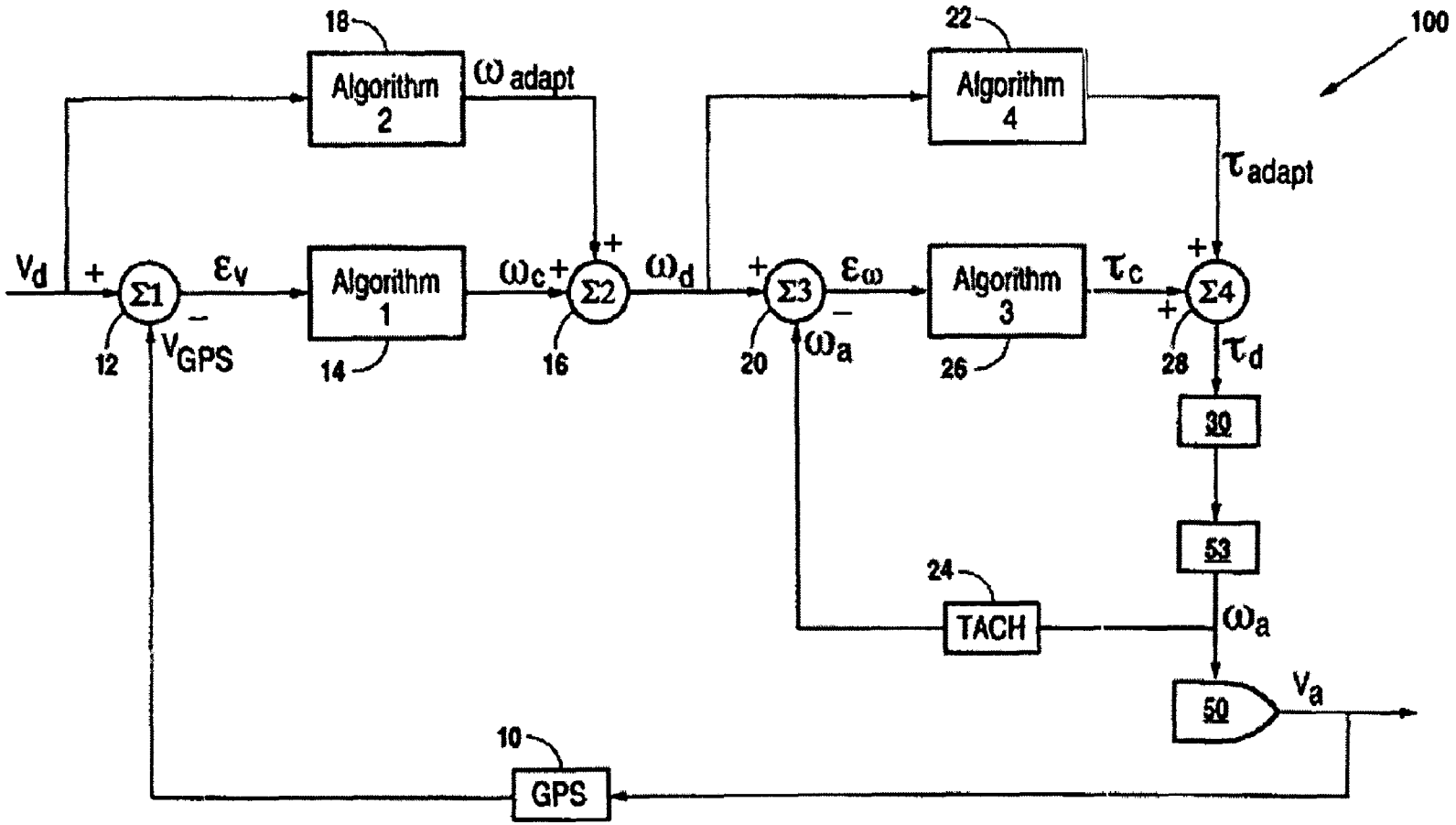
FIG. 1 is a flow diagram of the preferred embodiment of the present invention.

As diagrammed in FIG. 1 showing feedback system 100, GPS device 10 measures the actual velocity $v_a$ of a watercraft 50. The GPS output $v_{GPS}$ is compared in first comparator 12 to predetermined velocity $v_d$. Comparator 12 output velocity error $e_v$ is input to a first algorithm 14 that converts $e_v$ to engine speed correction $\omega_c$ that is input to a second comparator 16. Predetermined velocity $v_d$ is input to a second algorithm 18 the output of which is $\omega_{adapt}$, a value of engine speed adaptively determined to be the engine speed necessary to propel watercraft 50 at predetermined velocity $v_d$ under the prevailing conditions of wind, waves, and watercraft loading, trim angle, and attitude.

The addition of engine speed correction $\omega_c$ and engine speed $\omega_{adapt}$ in comparator 16 results in the total desired engine speed $\omega_d$ that is input to a third comparator 20. A sensor 24, one of many types of commonly understood tachometers, detects the actual angular velocity $\omega_a$ of a driveshaft from an engine 53 of watercraft 50 and sends it to third comparator 20. In third comparator 20 actual angular velocity $\omega_a$ and total desired engine speed $\omega_d$ are compared for engine speed error $e_\omega$ that is input to a third algorithm 26. In the third algorithm 26 engine speed error $e_\omega$ is converted into engine torque correction $\tau_c$.

Total desired engine speed $\omega_d$ is also input to a fourth algorithm 22 the output of which is $\tau_{adapt}$, a value of engine torque adaptively determined to be the engine torque necessary to operate watercraft engine 53 at total desired engine speed $\omega_d$. The addition of engine torque $\tau_{adapt}$ and engine torque correction $\tau_c$ in a fourth comparator 28 results in the calculated desired engine torque $\tau_d$. Calculated desired engine torque $\tau_d$ is input to controller 30 that drives a throttle control capable of producing in engine 53 a torque substantially equal to calculated desired engine torque $\tau_d$.

The first and third algorithms 14 and 26, respectively, could include any common or advanced control loop transfer function including, but not limited to, series, parallel, ideal, interacting, noninteracting, analog, classical, and Laplace types. For both the first and third algorithms 14 and 26 the preferred embodiment utilizes a simple proportional-integral-derivative (PID) algorithm of the following type (exemplified by the first algorithm 14 transfer function):

$$\omega_c = K_p e_v + K_d (d/dt) e_v + \int K_i e_v dt.$$

Where $K_p$, $K_d$, and $K_i$ are, respectively, the appropriate proportional, derivative, and integral gains.

The second and fourth algorithms 18 and 22, respectively, provide dynamically adaptive mapping between an input and an output. Such mapping can be described as self-modifying. The inputs to the second and fourth algorithms 18 and 22 are, respectively, predetermined velocity $v_d$ and total desired engine speed $\omega_d$. The outputs of the second and fourth algorithms 18 and 22 are, respectively, engine speed $\omega_{adapt}$ and engine torque $\tau_{adapt}$. The self-modifying correlations of algorithms 18 and 22 may be programmed during replicated calibration operations of a watercraft through a range of velocities in a desired set of ambient conditions including, but not limited to, wind, waves, and watercraft loading, trim angle, and attitude. Data triplets of watercraft velocity, engine speed, and engine torque are monitored with GPS technology and other commonly understood devices and fed to algorithms 18 and 22 during the calibration operations. Thereafter, a substantially instantaneous estimate of the engine speed required to obtain a desired watercraft velocity and a substantially instantaneous estimate of the engine torque required to obtain a desired engine speed can be fed to the engine speed and torque control loops, even in the absence of watercraft velocity or engine speed departures from desired values, in which cases the outputs of algorithms 14 and 26 may be zero.

Figure 2:
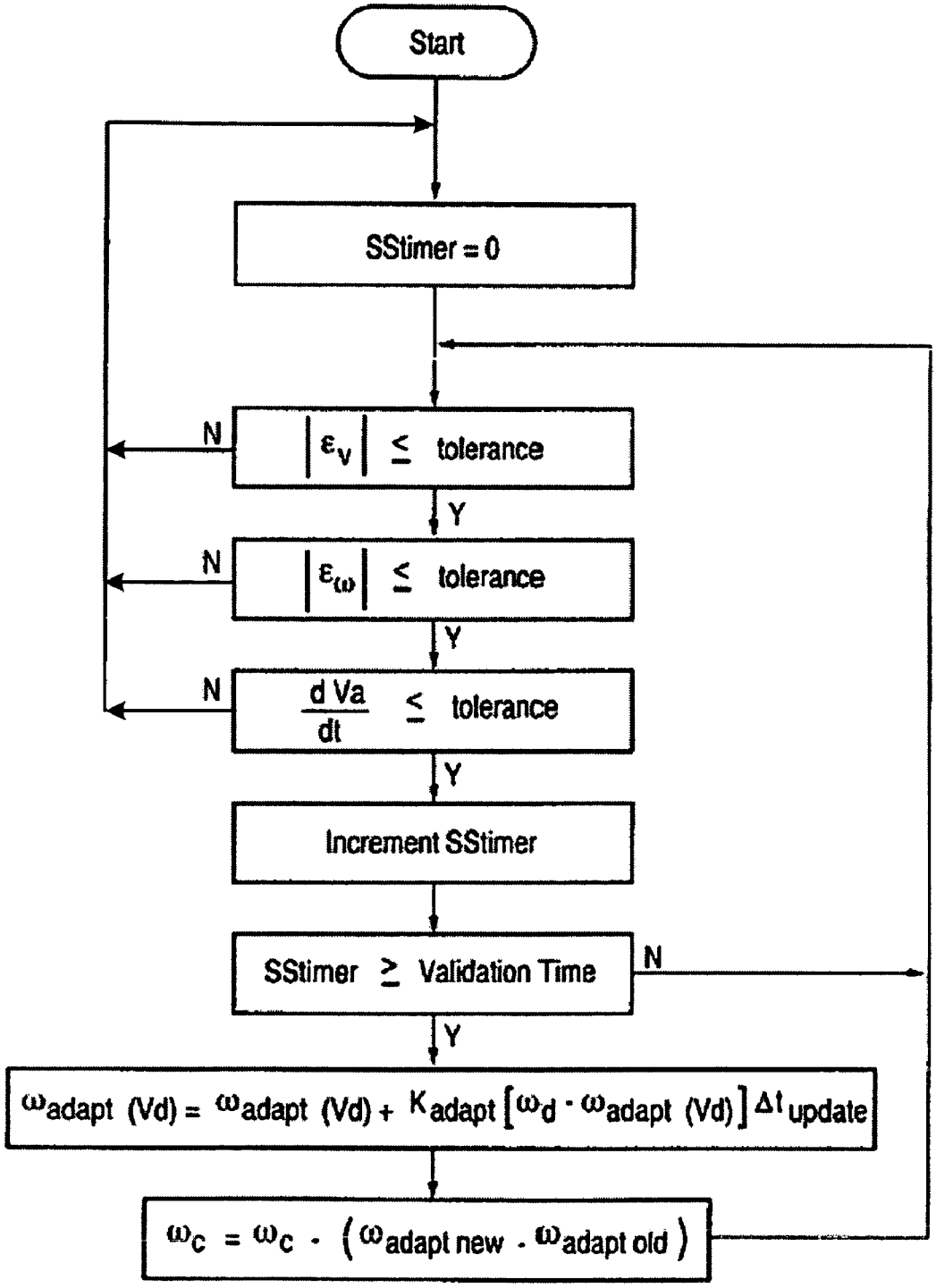
FIG. 2 is a flow chart of the steady state timer algorithm used in the preferred embodiment.

In the preferred embodiment, no adaptive data point of watercraft velocity, engine speed, or engine torque described above is programmed into algorithms 18 or 22 until it has attained a steady state condition as diagrammed in FIG. 2. A timer compares watercraft velocity error $e_v$, engine speed error $e_\omega$, the time rate of change of actual watercraft velocity $v_a$, and the time rate of change of actual engine speed $\omega_a$ to predetermined tolerance values. When the absolute value of each variable is less than or equal to its predetermined tolerance, and the time elapsed since the beginning of a sample event is greater than or equal to a predetermined validation time, $\omega_{adapt}$ is updated according to $$\omega_{adapt}(v_d)=\omega_{adapt}(v_d)+k_{adapt}[\omega_d\omega_{adapt}(v_d)]\Delta t_{update}$$

where $k_{adapt}$ and $\Delta t_{update}$ are factory-set parameters that together represent the speed at which the adaptive algorithms "learn" or develop a correlated data set. The last block on the FIG. 2 flowchart represents a correction to speed control algorithm 14. The correction may be used to smooth iterations that may be present if algorithm 14 uses integrator action.

When engine speed error $e_\omega$ and the time rate of change of actual engine speed $\omega_a$ decrease to predetermined tolerance values, and the time elapsed since the beginning of a sample event is greater than or equal to a predetermined validation time, $\tau_{adapt}$ is updated according to $$\tau_{adapt}(\omega_d)=\tau_{adapt}(\omega_d)+k_{adapt}[\tau_d-\tau_{adapt}(\omega_d)]\Delta t_{update}.$$

This is the same updating equation that is used in algorithm 18, and it is derived in the same manner as is illustrated in FIG. 2. The smoothing technique described above may be used to counter the effects of integrator action in algorithm 26.

The substantially instantaneous estimates of engine speed and torque derived from algorithms 18 and 22 require interpolation among the discrete values programmed during watercraft calibration operation. For practice of the present invention there are many acceptable interpolation schemes, including high-order and Lagrangian polynomials, but the preferred embodiment utilizes a linear interpolation scheme. For example, algorithm 18 employs linear interpolation to calculate a value of $\omega_{adapt}$ for any predetermined velocity $v_d$. From a programmed table of $v_d$ values from $v_0$ to $v_n$, inclusive of $v_m$, and $\omega_{adapt}$ values from $\omega_0$ to $\omega_n$, inclusive of $\omega_m$, a value of m is chosen so that $v_d>v_m$ and $v_d<v_{m+1}$. Algorithm 18 calculates intermediate values of engine speed according to the equation $$\omega_{adapt}=\omega_m+[(v_d-v_m)/(v_{m+1}-v_m)](\omega_{m+1}-\omega_m).$$

Although algorithm 22 could also utilize any of several interpolation schemes, and is not constrained to duplication of algorithm 18, in the preferred embodiment of the present invention, algorithm 22 calculates $\tau_{adapt}$ using the same linear interpolation that algorithm 18 uses to calculate $\omega_{adapt}$. In order to implement adaptive update algorithm 18 when using a linearly interpolated table of values as the preferred interpolation embodiment, the following procedure can be followed:

Compute a weighting factor x using the following equation:

$$x=[(v_d-v_m)/(v_{m+1}-v_m)]$$

Note that x is always a value between 0 and 1.

Similar to algorithm of 18, update the two bracketing values $\omega_m$, $\omega_{m+1}$ in the linear table using the following equations:

$$\omega_m=\omega_m+(1-x)k_{adapt}[\omega_d-\omega_{adapt}]\Delta t_{update}$$

$$\omega_{m+1}=\omega_{m+1}+(x)k_{adapt}[\omega_d-\omega_{adapt}]\Delta t_{update}$$

The other values in the linear table remain unchanged for this particular update, and are only updated when they bracket the operating condition of the engine at some other time. This same procedure can be used on the engine speed vs. torque adaptive table.

Although the preferred embodiment does not utilize extrapolation in its adaptive algorithms, the scope of the present invention could easily accommodate commonly understood extrapolation routines for extension of the algorithm 18 and algorithm 22 data sets.

Adaptive algorithms 18 and 22 are not required for operation of the present invention, but they are incorporated into the preferred embodiment. Aided by commonly understood integrators, algorithms 14 and 26 are capable of ultimate control of a watercraft's velocity. However, the additional adaptive control provided by algorithms 18 and 22 enhances the overall transient response of system 100.

The following table is an example of the velocity vs. engine speed adaptive table as it might be initialized from the factory. This table is a simple linear table which starts at zero velocity and extends to the maximum velocity of the boat (60 kph) at which the maximum engine speed rating (6000 rpm) is also reached:

| $v_d$ (kph) | $\omega_{adapt}$ (rpm) |
|---|---|
| 0 | 0 |
| 10 | 1000 |
| 20 | 2000 |
| 30 | 3000 |
| 40 | 4000 |
| 50 | 5000 |
| 60 | 6000 |

The following is an example of the velocity vs. engine speed adaptive after the boat has been driven for a period of time:

| $v_d$ (kph) | $\omega_{adapt}$ (rpm) |
|---|---|
| 0 | 0 |
| 10 | 1080 |
| 20 | 1810 |
| 30 | 2752 |
| 40 | 3810 |
| 50 | 5000 |
| 60 | 6000 |

Figure 4:
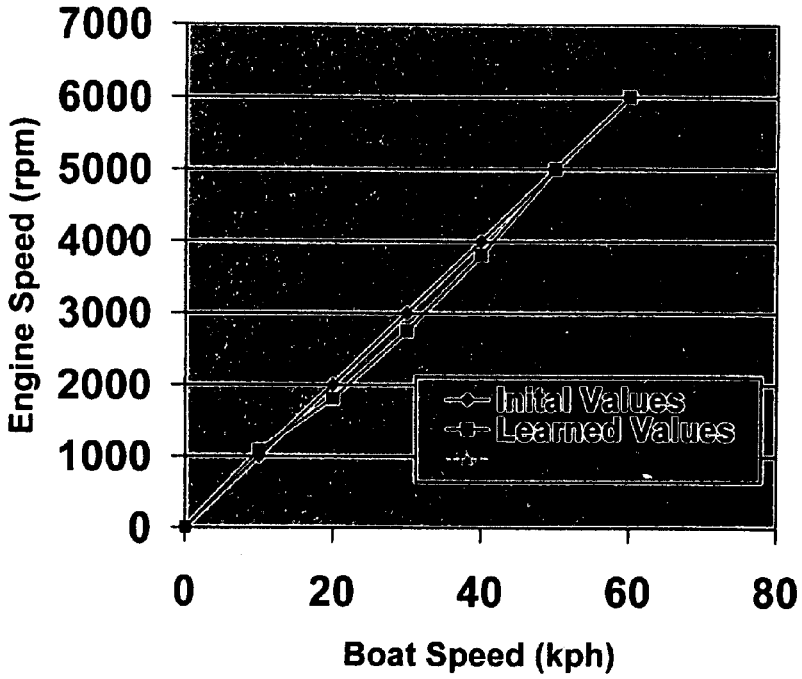
FIG. 4 is a graphical representation of the data shown in tables herein.

Note that engine speed values correlating to boat speeds of 50 and 60 kph have not been modified from the original initial values. This is because the boat was never operated at these desired speeds during the period of operation between the present table and the initial installation of the controller. FIG. 4 is a graphical representation of the data in the preceding table.

Controller 30 (see FIG. 1) is the interface between calculated desired engine torque $\tau_d$ and the throttle control that causes the ultimate changes in engine speed. Controller 30 may interpose any number of relationships between calculated desired engine torque $\tau_d$ and engine speed, but the preferred embodiment of the present invention utilizes a direct proportionality. Other embodiments of the present invention could use controller 30 to adjust engine parameters other than throttle setting. Such parameters could include spark timing, fuel flow rate, or air flow rate. The preferred embodiment of the present invention contemplates a boat with a single speed transmission and a fixed pitch propeller. An alternate embodiment of the present invention could be used with boats having variable transmissions and/or variable pitch propellers. In these alternate embodiments, the controller 30 could adjust the transmission, pitch of the propeller, throttle setting, or a combination thereof.

Figure 3:
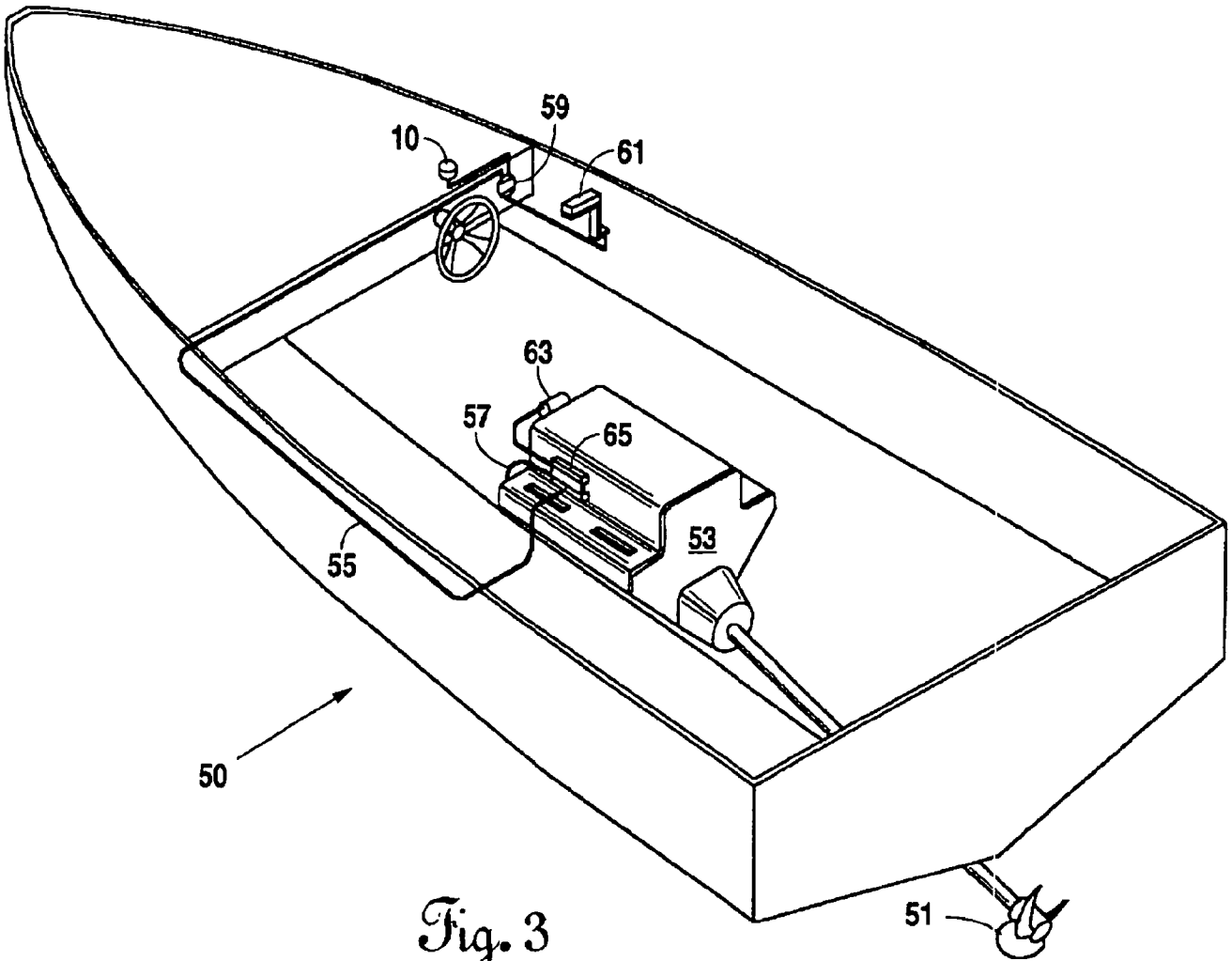
FIG. 3 is a schematic of a watercraft utilizing the present invention.

FIG. 3 illustrates how an operator of watercraft 50 controls the speed of engine 53 and propeller 51. The operator supplies predetermined and desired velocity $v_d$ through control keypad and display 59 to control module 65 that houses the algorithms and comparators of system 100. GPS measurements from device 10 and predetermined velocity $v_d$ values are sent to control module 65 via communications link 55. Communication link 57 feeds engine speed measurements from a tachometer to control module 65. System 100 may be overridden at any time through operator control of manual throttle control 61 that controls engine throttle 63.

It will be apparent to those with ordinary skill in the relevant art having the benefit of this disclosure that the present invention provides an apparatus for controlling the velocity of a watercraft. It is understood that the forms of the invention shown and described in the detailed description and the drawings are to be taken merely as presently preferred examples and that the invention is limited only by the language of the claims. The drawings and detailed description presented herein are not intended to limit the invention to the particular embodiments disclosed. While the present invention has been described in terms of one preferred embodiment and a few variations thereof, it will be apparent to those skilled in the art that form and detail modifications can be made to that embodiment without departing from the spirit or scope of the invention.

We claim:

1. An apparatus for controlling the velocity magnitude of a watercraft, said apparatus comprising:

a GPS device capable of obtaining a measurement of the velocity magnitude of said watercraft;

a first comparator capable of determining the velocity magnitude difference between said GPS velocity measurement and a predetermined velocity;

a first algorithm capable of creating a first engine speed output correction from said velocity magnitude difference;

a tachometer device capable of measuring the speed of an engine propelling said watercraft;

a third comparator capable of summing said tachometer speed measurement and said first engine speed output correction of said first algorithm;

a third algorithm capable of converting said sum of said tachometer speed measurement and said first engine speed output correction of said first algorithm into a first engine torque output correction, and said first engine torque output correction being capable of causing said watercraft to be propelled at substantially said predetermined velocity.

2. An apparatus for controlling the velocity magnitude of a watercraft, said apparatus comprising;

a GPS device capable of obtaining a measurement of the velocity magnitude of said watercraft;

a first comparator capable of determining the velocity magnitude difference between said GPS velocity measurement and a predetermined velocity;

a first algorithm capable of creating a first engine speed output correction from said velocity magnitude difference;

a second algorithm capable of creating a second engine speed output correction corresponding to an input representative of said predetermined velocity, said second engine speed output correction representing a dynamic historical value of the speed of an engine propelling said watercraft at a velocity approximately equal to said predetermined velocity; and a second comparator capable of summing said first engine speed output correction of said first algorithm and said second engine speed output correction of said second algorithm, said sum capable of causing said watercraft to be propelled at substantially said predetermined velocity.

3. An apparatus as in claim 2 wherein said second algorithm is capable of building a table of discrete data pairs of velocity magnitude and engine speed of said watercraft as said watercraft is repeatedly operated for calibration over a prevailing set of ambient conditions, said second algorithm being capable of determining interpolated and extrapolated data points among and extending from said data pairs collected during said calibration operation of said watercraft.

4. An apparatus as in claim 3 wherein said second algorithm is capable of determining a condition of predetermined change in a predetermined parameter prior to updating said table.

5. An apparatus as in claim 1 further comprising:

a fourth algorithm capable of creating a second engine torque output correction corresponding to an input representative of said first engine speed output correction of said first algorithm, said second engine torque output correction representing a dynamic historical value of the torque required to change the engine speed of an engine propelling said watercraft an amount approximately equal to said first engine speed output correction of said first algorithm; and a fourth comparator capable of summing said first engine torque output correction of said third algorithm and said second engine torque output correction of said fourth algorithm, said sum being capable of causing said watercraft to be propelled at substantially said predetermined velocity.

6. An apparatus as in claim 5 wherein said fourth algorithm is capable of building a table of discrete data pairs of engine speed correction and torque required to produce said engine speed correction as said watercraft is repeatedly operated for calibration over a prevailing set of ambient conditions, said fourth algorithm being capable of determining interpolated and extrapolated data points among and extending from said data pairs collected during said calibration operation of said watercraft.

7. An apparatus as in claim 6 wherein said fourth algorithm is capable of determining a condition of predetermined change in a predetermined parameter prior to updating said table.

8. An apparatus as in claim 5 wherein said fourth algorithm is capable of building a table of discrete data pairs of engine speed and torque required to produce said engine speed as said watercraft is repeatedly operated for calibration over a prevailing set of ambient conditions, said fourth algorithm being capable of determining interpolated and extrapolated data points among and extending from said data pairs collected during said calibration operation of said watercraft.

9. An apparatus as in claim 8 wherein said fourth algorithm is capable of determining a condition of predetermined change in a predetermined parameter prior to updating said table.

10. An apparatus as in claim 1 wherein said first algorithm includes an advanced control loop function.

11. An apparatus as in claim 10 wherein said advanced control loop function is selected from the group consisting of a series, a parallel, an ideal, an interacting, a noninteracting, an analog, a classical, and a Laplace function.

12. An apparatus as in claim 1 wherein said first algorithm is selected from the group consisting of a proportional-integral-derivative algorithm, a proportional algorithm, an integral algorithm, and a derivative algorithm.

13. An apparatus as in claim 1 wherein said third algorithm includes an advanced control loop function.

14. An apparatus as in claim 13 wherein said advanced control loop function is selected from the group consisting of a series, a parallel, an ideal, an interacting, a noninteracting, an analog, a classical, and a Laplace function.

15. An apparatus as in claim 1 wherein said third algorithm is selected from the group consisting of a proportional-integral-derivative algorithm, a proportional algorithm, an integral algorithm, and a derivative algorithm.

16. An apparatus for controlling the velocity magnitude of a watercraft, said apparatus comprising:

a GPS device capable of obtaining a measurement of the velocity magnitude of said watercraft;

a first comparator capable of determining the velocity magnitude difference between said GPS velocity measurement and a predetermined velocity;

a first algorithm capable of creating a first engine speed output correction from said velocity magnitude difference;

a second algorithm capable of creating a second engine speed output correction corresponding to an input representative of said predetermined velocity, said second engine speed output correction representing a dynamic historical value of the speed of an engine propelling said watercraft at a velocity approximately equal to said predetermined velocity;

a second comparator capable of summing said first engine speed output correction of said first algorithm and said second engine speed output correction of said second algorithm;

a tachometer device capable of measuring the speed of said engine propelling said watercraft;

a third comparator capable of determining the engine speed difference between said tachometer speed measurement and said sum of said first engine speed output correction of said first algorithm and said second engine speed output correction of said second algorithm;

a third algorithm capable of converting said engine speed difference between said tachometer speed measurement and said sum of said first engine speed output correction of said first algorithm and said second engine speed output correction of said second algorithm into a first engine torque output correction from said engine speed magnitude difference;

a fourth algorithm capable of creating a second engine torque output correction corresponding to an input representative of said sum of said first engine speed output correction of said first algorithm and said second engine speed output correction of said second algorithm, said second engine torque output correction representing a dynamic historical value of the torque required to produce an engine speed of said engine propelling said watercraft approximately equal to said sum of said first engine speed output correction of said first algorithm and said second engine speed output correction of said second algorithm; and a fourth comparator capable of summing said first engine torque output correction of said third algorithm and said second engine torque output correction of said fourth algorithm, said sum being capable of causing said watercraft to be propelled at substantially said predetermined velocity.

17. An apparatus for controlling the speed of a watercraft, said apparatus comprising:

a GPS device capable of obtaining a measurement of the velocity of said watercraft;

a first comparator capable of determining the velocity difference between said GPS velocity measurement and a predetermined velocity;

a first algorithm applied to said velocity difference and providing a first engine speed output correction;

a tachometer device capable of measuring the revolutions per minute of a drive shaft of an engine propelling said watercraft;

a third comparator capable of summing said tachometer revolutions per minute measurement and said first engine speed output correction of said first algorithm; and a third algorithm applied to said sum of said tachometer revolutions per minute measurement and said first engine speed output correction of said first algorithm and providing a first engine torque output correction, said first engine torque output correction being capable of causing said watercraft to be propelled at substantially said predetermined velocity.

18. An apparatus as in claim 17 wherein said first algorithm is selected from the group consisting of a proportional-integral-derivative algorithm, a proportional algorithm, an integral algorithm, and a derivative algorithm.

19. An apparatus as in claim 17 wherein said third algorithm is selected from the group consisting of a proportional-integral-derivative algorithm, a proportional algorithm, an integral algorithm, and a derivative algorithm.

20. An apparatus as in claim 17 wherein said first algorithm includes an advanced control loop function.

21. An apparatus as in claim 20 wherein said advanced control loop function is selected from the group consisting of a series, a parallel, an ideal, an interacting, a noninteracting, an analog, a classical, and a Laplace function.

22. An apparatus as in claim 17 wherein said third algorithm includes an advanced control loop function.

23. An apparatus as in claim 22 wherein said advanced control loop function is selected from the group consisting of a series, a parallel, an ideal, an interacting, a noninteracting, an analog, a classical, and a Laplace function.

* * * * *